United States Patent [19]

Furrow et al.

[11] Patent Number: 4,978,029

[45] Date of Patent: Dec. 18, 1990

[54] MULTI-FUEL DISPENSER WITH ONE NOZZLE PER FUELING POSITION

[75] Inventors: Roger W. Furrow, High Point; Harold R. Young, Kernersville, both of N.C.

[73] Assignee: Gilbarco Inc., Greensboro, N.C.

[21] Appl. No.: 375,255

[22] Filed: Jul. 3, 1989

[51] Int. Cl.[5] ..... B67D 5/06

[52] U.S. Cl. ..... 222/1; 222/23; 222/26; 222/57; 222/132; 222/134; 222/135; 222/145; 235/94 A

[58] Field of Search ..... 222/1, 134, 23–28, 222/52, 57, 71, 642, 132, 135, 145, 144.5, 30; 239/61; 141/302; 138/114; 235/94 A

[56] References Cited

U.S. PATENT DOCUMENTS

| | | | |
|---|---|---|---|
| 3,416,552 | 12/1968 | Hildebrandt | 222/26 X |
| 3,727,796 | 4/1973 | Young | 222/26 |
| 3,756,463 | 9/1973 | Gravina | 222/26 |
| 3,777,935 | 12/1973 | Storey | 222/26 X |
| 3,895,738 | 7/1975 | Buchanan et al. | 222/26 |
| 4,083,473 | 4/1978 | Goodwin et al. | 222/26 X |
| 4,150,767 | 4/1979 | Pitches et al. | 222/57 X |
| 4,306,594 | 12/1981 | Planck | 141/302 X |
| 4,570,686 | 2/1986 | Devine | 138/114 X |

*Primary Examiner*—Andres Kashnikow
*Assistant Examiner*—Gregory L. Huson
*Attorney, Agent, or Firm*—Kenneth Watov

[57] ABSTRACT

A dispenser for delivering different grades of gasoline through a single nozzle at each fueling position, includes a pair of hoses connected to the nozzle, one of which hoses is used for selectively delivering high octane gasoline, and the other of which hoses is for selectively delivering either low octane or mid octane gasoline through the nozzle, whereby a control system is programmed for monitoring the dispensing of low octane gasoline relative to the dispensing of mid octane gasoline, for injecting a sufficient quantity of high octane gasoline through the nozzle at the initiator of a mid octane dispensing cycle for compensating for low octane fuel remaining in the other hose from an immediately prior low octane dispensing cycle relative to a mid octane dispensing cycle.

23 Claims, 8 Drawing Sheets

MULTI-FUEL DISPENSER WITH ONE NOZZLE PER FUELING POSITION

FIELD OF THE INVENTION

The present invention relates generally to fuel dispensers, and more particularly to such dispensers for dispensing a plurality of different fuels, such as gasoline, for example, having different octanes.

BACKGROUND OF THE INVENTION

Many gasoline service stations require the installation of multi-fuel dispensers, each for dispensing a plurality of different grades or octane levels of gasoline products at each fueling position. Known dispensers or pumps typically include a separate hose, nozzle and nozzle boot for each fuel product or octane level of gasoline capable of being dispensed at an associated fueling position. Note that such dispensing systems are known as "wet hose systems", in which the hose remains filled with fuel from the most recent delivery. Through the use of such separate hoses, dispensers of the prior art avoid contamination of fuel being dispensed at a particular time, with fuel from a previous delivery that may remain in the hose at the termination of the last or prior to the last dispensing cycles. Buchanan et al U.S. Pat. No. 3,895,738 discloses such a dispenser, in which three fuel hoses, each for a different grade of gasoline, are used in a concentric hose configuration.

If the same hose is used for all fuel, the fuel remaining in the hose is of a different grade or octane level than fuel to be dispensed in the next subsequent dispensing cycle, contamination of the initial quantity of fuel delivered in the next dispensing cycle will occur through initial mixing of the desired fuel with the fuel remaining from the prior dispensing cycle. As long as the fuel being delivered in a given dispensing cycle is of a lower or equal octane or grade level than the residual fuel in the hose, a customer will receive at least the same or initially a higher grade of fuel, and suffer no detriment. However, if for example a lower octane gasoline was delivered in the last dispensing cycle, relative to fuel being delivered in a present dispensing cycle, through the same hose, a customer will initially receive a lower octane or grade level of fuel than requested. As previously mentioned, prior dispensing systems use separate hoses, nozzles and nozzle boots for each fuel available at a given fueling station, to avoid such fuel contamination during the initial phases of a given dispensing cycle.

There are many disadvantages in the use of discrete hoses for multi-fuel dispensers of the prior art. The cost of such dispensers is increased via the requirement for multiple hoses, each associated with an individual nozzle and nozzle boot. Also, the operation of such dispensers is substantially more complicated, and therefore more confusing for a user to operate. Another problem with such multi-hose dispensers is that the hoses sometimes become tangled with one another. The use of multiple hoses also compromises the appearance of such dispensers and increases the overall size and space requirements of the dispenser.

SUMMARY OF THE INVENTION

An object of the invention is to provide an improved multi-fuel dispenser.

Another object of the invention is to simplify the operation of the multi-fuel dispenser.

Yet another object of the invention is to provide an improved multi-fuel dispenser requiring but a single nozzle, nozzle boot and product hose at each fueling position.

With the problems of the prior art in mind, these and other objects of the invention are provided in one embodiment of the invention via a single nozzle per fueling position multi-fuel dispenser, including a nozzle connected to a hose-within-a-hose system consisting of an outer hose for receiving all grades of gasoline except the highest octane, an inner hose inside the outer hose for receiving the highest octane gasoline, and product supply means for injecting or delivering a sufficient quantity of high octane gasoline to the nozzle via the inner hose, to compensate for low octane gasoline remaining in the outer hose from a prior low octane dispensing cycle at the initiation of a dispensing cycle for dispensing mid octane fuel, to insure that the total product delivered is at least of a mid octane grade of fuel. Alternatively, the lower octane gasolines could be received by the inner hose and the highest octane could be received by the outer hose.

DESCRIPTION OF THE PREFERRED EMBODIMENTS OF THE INVENTION

Figure 1:
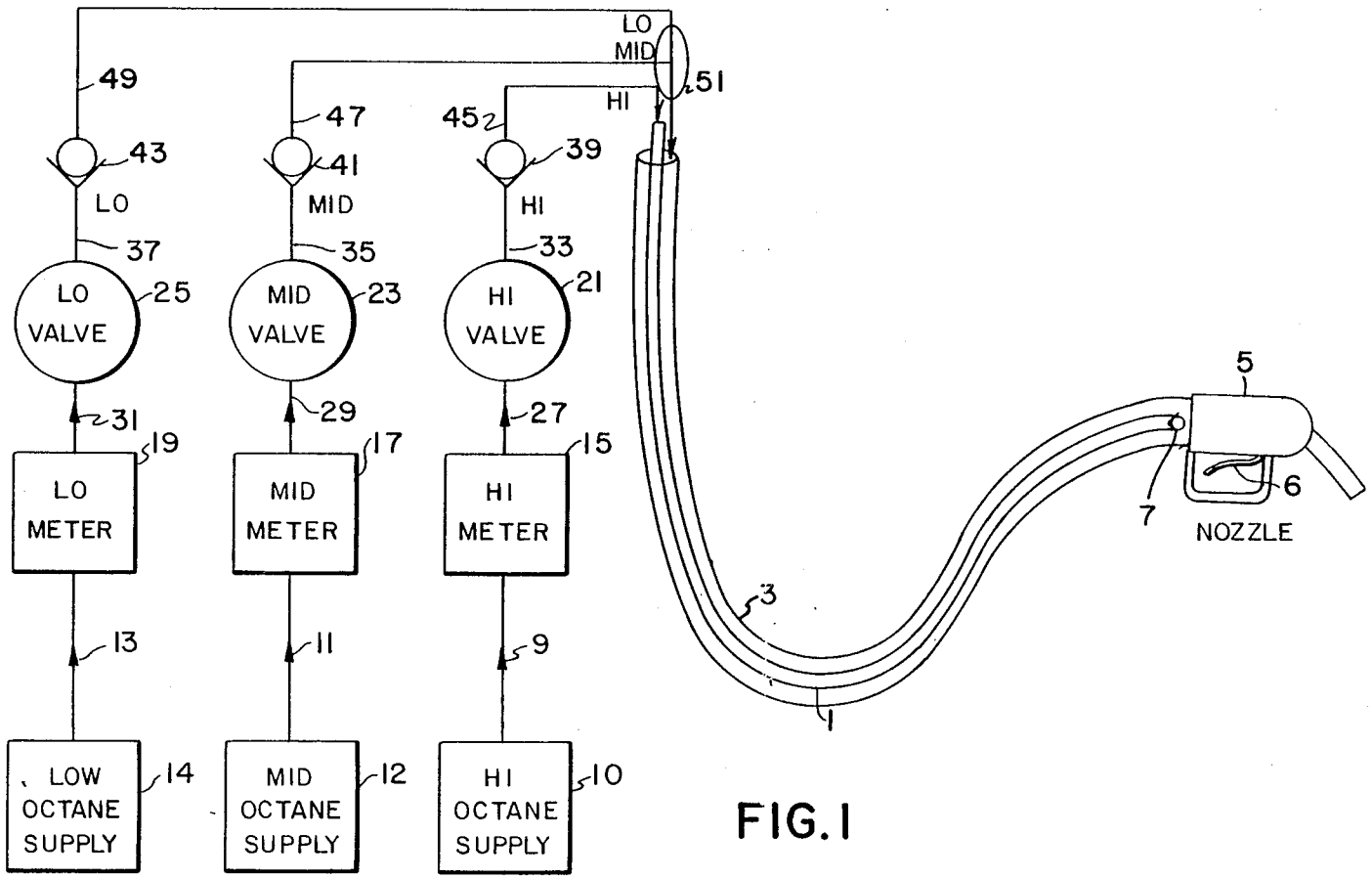
FIG. 1 is a partial pictorial and partial block diagram of one embodiment of the invention.

With reference to FIG. 1, in one embodiment of the invention, relative to a user, a single nozzle per fueling position fuel dispenser, in this example a gasoline dispenser, is provided via an inner hose 1 contained within an outer hose 3. A dispensing nozzle 5 is connected to one end of the hoses 3 via conventional hose connection means (not shown). In this example, the inner hose 1 terminates at a check valve 7 shown at the end of the inner hose 1 proximate or connected to the nozzle 5, but in practice it has been determined that the check valve 7 may not be required, as will be described below. Also, in this example, pumps (not shown) are connected to high octane, mid octane and low octane supplies or sources of gasoline 10, 12, and 14, respectively, for delivering under pressure high octane, mid octane, and low octane gasoline, in this example, via fuel supply lines 9, 11, and 13, respectively. The fuel lines 9, 11, and 13 are coupled indirectly via valves or filters, for example, or directly to input ports of meters 15, 17, and 19, respectively. The output ports of "HI" meter 15, "MID" meter 17, and "LO" meter 19 are connected to the input ports of "HI", "MID", and "LO" flow control valves 21, 23, and 25, respectively, via fuel lines 27, 29, 31, respectively. Fuel lines 33, 35, and 37 are connected between the output ports of valves 21, 23, and 25, respectively, and the input ports of check valves 39, 41, and 43, respectively.

Figure 1A:
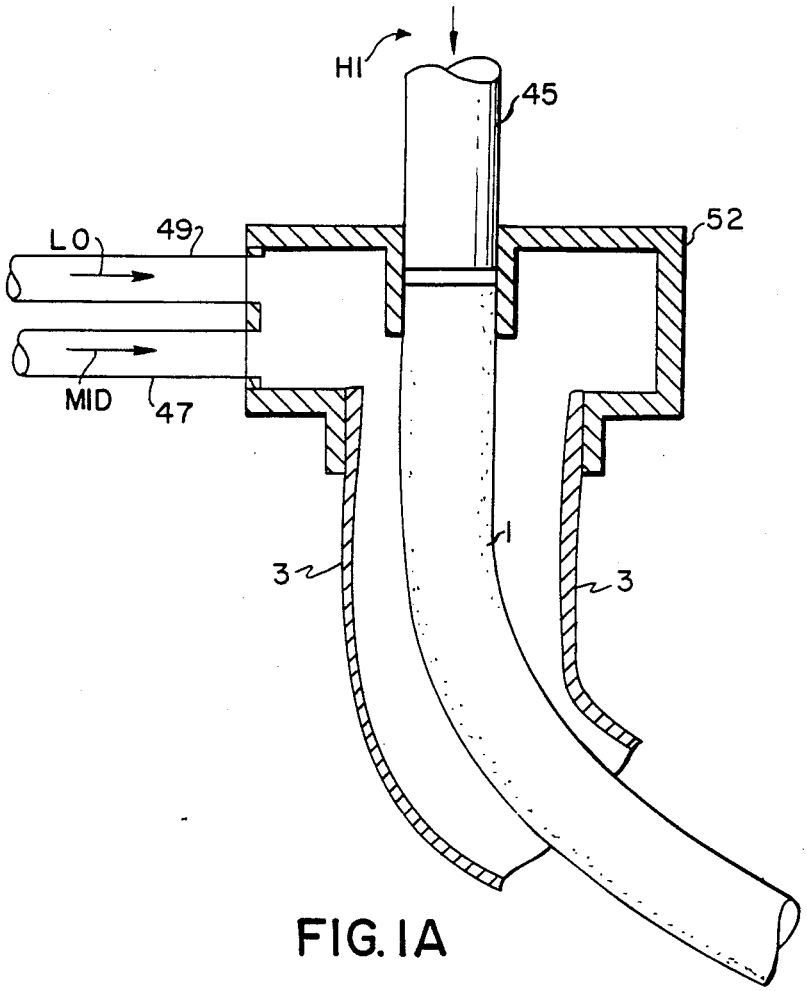
FIG. 1A is a partial pictorial and cutaway sectional view of a hose adapter manifold of one embodiment of the invention.

Note that the flow meters 15, 17, and 19 need only be positioned somewhere in their associated product or fuel flow path, and therefore can be placed either upstream or downstream of their associated flow control valves 21, 23, and 25, respectively. The output port of check valve 39 is connected via fuel line 45 to the other end of product hose 1 via standard coupling means (not shown). Also, the output ports of check valves 41 and 43 are connected via fuel lines 47 and 49 to the other end of fuel hose 3 via a mixing manifold 51. For example, a two-hose-to-single-hose adapter manifold 52, as shown in FIG. 1A, can be used for connecting fuel lines 47 and 49 to hose 3, and fuel line 45 to hose 1. Manifold 52 can be fabricated from a casting, for example. The fuel lines 45, 47, and 49, and hoses and 3 are secured to adapter manifold 52 via conventional mechanical clamping or bonding. Also as would be known by one of ordinary skill in the art, other devices such as filters, for example, may be placed in the fuel flow paths.

Figure 2:
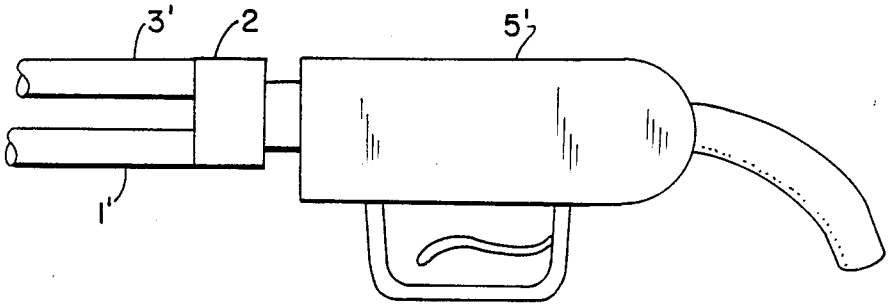
FIG. 2 is a partial pictorial diagram showing an alternative product hose arrangement relative to the embodiment of FIG. 1.

In practice, although a hose within a hose configuration of the fuel hoses and 3 are preferred as shown in FIG. 1, the hoses can also be made independent of one another for coupling to a nozzle 5'. For example, as shown in FIG. 2, independent hoses 1' and 3' are connected via a mixing manifold 2 to a nozzle 5'. The hoses 1' and 3' are individually attached to inlet ports of manifold 2, with an outlet port of manifold 2 being connected to an inlet port of nozzle 5'. The two hoses 1' and 3', in one embodiment are bond together by appropriate nylon banding material, or other binding means (not shown), for example, to function together as nearly as possible as a single hose system. In this example, hose 1' is connected to carry high octane fuel similar to hose 1. Hose 3' is connected to a mixing manifold such as manifold 51 (see FIG. 1) for receiving either low or mid octane fuel similar to hose 3. Note that in the preferred embodiment, a single hose is always dedicated to carrying only high octane fuel.

Figure 3:
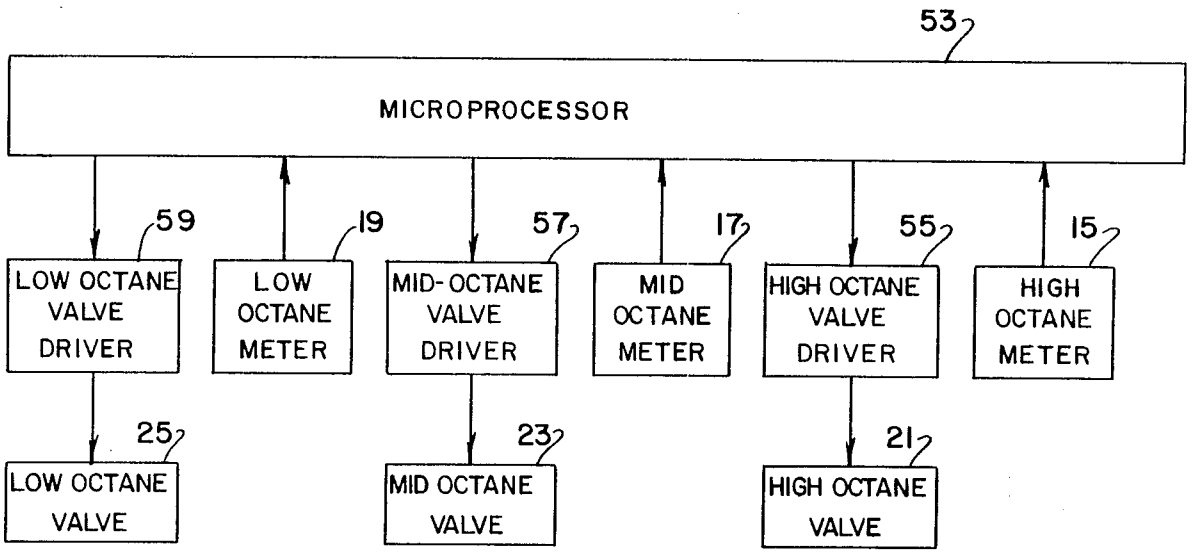
FIG. 3 is a block schematic diagram of a control system for one embodiment of the invention.

An example of a control system for one embodiment of the invention is shown in FIG. 3. As illustrated, a microprocessor 53 is electrically connected to high, mid, and low octane meters 15, 17, 19, respectively, and to high, mid, and low valve driver circuits 55, 57, and 59, respectively. The high, mid, and low octane valve drivers 55, 57, and 59, are also electrically connected to the valve solenoid windings (not shown) of the high, mid, and low octane valves 21, 23, and 25, respectively, for operating these valves. The microprocessor 53 is programmed, as will be described in greater detail below, to receive signals from the product meters or flow meters 15, 17, and 19 for monitoring the amount of a given grade of fuel being dispensed during a given dispensing cycle, and for, at appropriate times, turning on the appropriate valve drivers 55, 57 and 59 for selectively operating the high, mid, and low octane valves 21, 23, and 25, respectively. While conventional on or off solenoid valves with one coil are described, the control system may use more complex valves such as two stage, proportional variable position, or stepper motor controlled proportional valves, for providing valves 21, 23, and 25.

In operating the present dispensing system, a user selects via a control panel (not shown for purposes of simplification) a desired grade of fuel or octane level of gasoline, in this example, for dispensing. A signal is provided to the microprocessor indicative of the grade of fuel to be dispensed. Other signals may be provided to the microprocessor 53 that are indicative also of the quantity of the selected fuel to be dispensed, or of the quantity of fuel metered, or the activation of a stop switch (not shown), for signaling that a given dispensing cycle is to be terminated. Such signaling and control is accomplished via known control systems.

Figure 4:
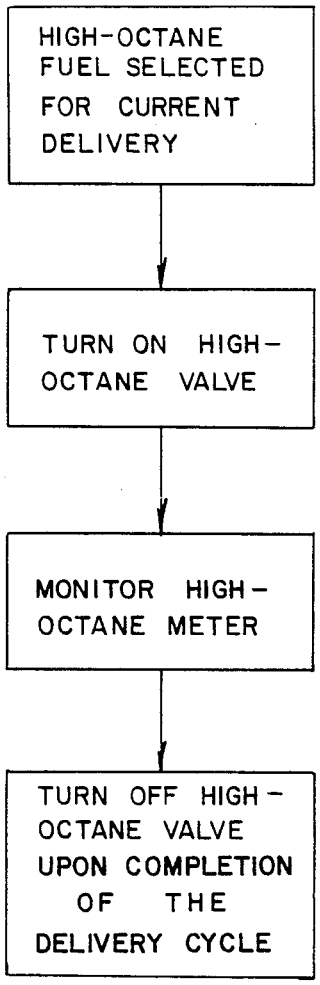
FIG. 4 is a flowchart showing the programming for delivering high octane fuel in one embodiment of the invention.

With reference to FIG. 4, if a high octane fuel is selected for current delivery, the microprocessor 53 responds by providing a signal to the high octane valve driver 55 for turning on the high octane valve 21. I n a preset mode of operation, microprocessor 53 then monitors the high octane meter 15, and turns off the high octane valve 21 upon delivery of the desired or preset quantity of high octane fuel or gasoline. Also, as previously mentioned, microprocessor 53 will respond to a stop termination signal for turning off the high octane valve 21, whenever a user elects to terminate a given dispensing cycle. In any given dispensing cycle, a particular quantity of high octane fuel may or may not be selected by a user. A user may elect to operate a nozzle 5 manually, instead of automatically, as is known in the art.

Note that during testing of a prototype system of the present invention, it was determined that in the configuration of FIG. 1, whenever high octane fuel is flowing from the inner hose 1 through the nozzle 5, that only an insignificant quantity of fuel in the outer hose 3, that is in the area of the outer hose between the outside of the inner hose 1 and the inside wall of the outer hose 3, will flow into the nozzle 5 or mix with the high octane fuel being dispensed when the lower octane valves 23 and 25 are closed. The primary reason for this is that when the low and mid octane valves 25, 23 are closed, there is no pressure differential in the stagnate fuel in the outer hose 3 to cause the stagnate fuel to flow into, and be mixed with, the flowing fuel in the inner hose 1. No pressure will be available to cause valves 23 or 25 is reopened. Also, the flow of fuel from the inner fuel hose 1 through the nozzle 5 tends to create a back pressure, which also assists in preventing fuel flow, due to gravity from the area between the inner hose 1 and outer hose 3, into nozzle 5 and mixing with the high octane fuel being delivered. Accordingly, for the dispensing of high octane fuel, no detrimental mixing of the high octane fuel being delivered with a lower octane fuel from the outer hose 3 occurs to an extent sufficient to cause a detriment to the customer receiving the high octane fuel.

Figure 5:
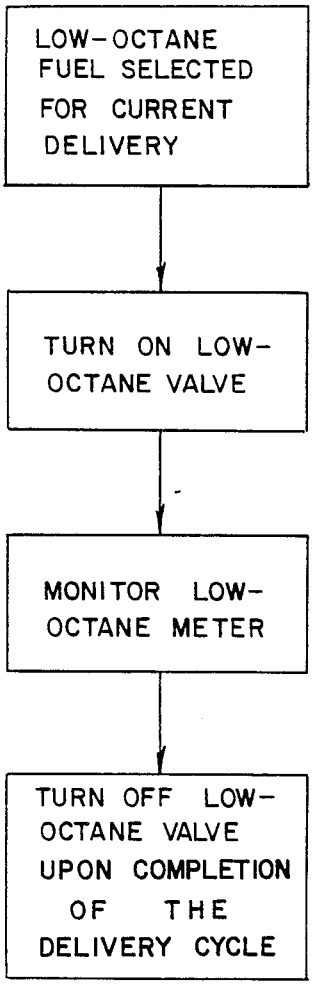
FIG. 5 is a flowchart showing the programming for delivering low octane fuel in one embodiment of the invention.

Microprocessor 53 is programmed to operate as shown in the flowchart of FIG. 5 for turning on low octane valve 59 for dispensing low octane fuel. Note that similar to the previously described high octane fuel dispensing cycle, if a user elects to terminate a dispensing cycle at any given time for low octane fuel, microprocessor 53 responds to a stop signal by turning off the low octane valve 25. Note that in any given dispensing cycle, a particular quantity of fuel for delivery may or may not be selected by a user. In certain instances a user may elect to operate the nozzle 5 manually instead of in an automatic mode, as is known in the art.

The microprocessor 53 is programmed to track the delivery of mid octane fuel relative to low octane fuel. The reason for such monitoring is that if a mid octane fuel or gasoline is selected for dispensing by a user for a present dispensing cycle, the mid octane fuel will be diluted by low octane fuel remaining in the outer hose 3, if the immediately prior dispensing cycle through outer hose 3 was for low octane fuel. To compensate for such dilution of mid octane fuel, the microprocessor 53 is programmed to operate either as shown in the flow chart of FIG. 6, or in the alternative embodiments as shown in the flows charts of FIGS. 7, 8 and 9.

Figure 6:
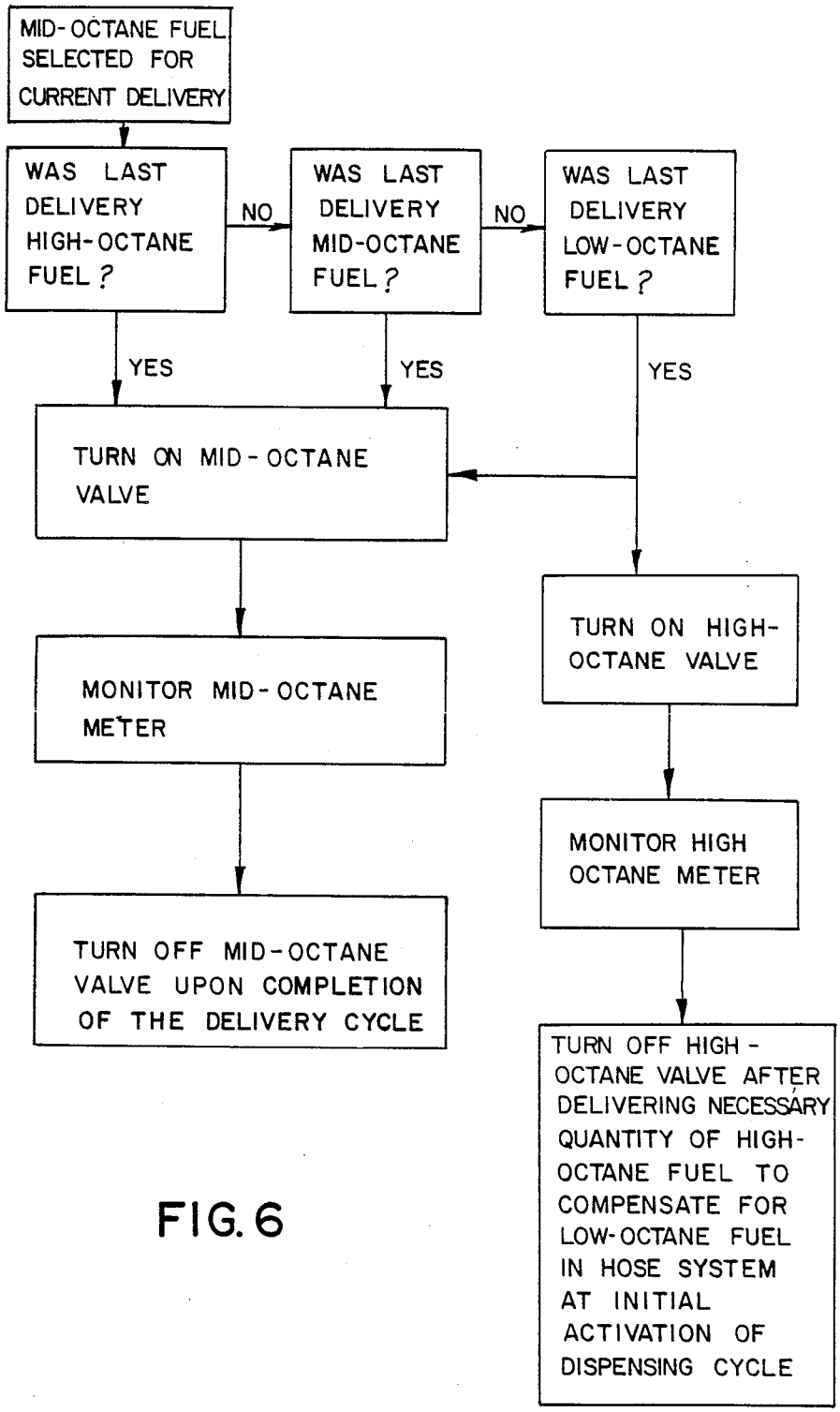
FIGS. 6 through 9 are individual flowcharts showing the programming for delivering mid octane fuel in four different embodiments of the invention, respectively.

As shown in the embodiment of FIG. 6, at the initiation of a mid octane fuel dispensing cycle, if the last dispensing cycle through outer hose 3 was for low octane fuel, the microprocessor 53 is programmed to turn on both the mid octane and high octane valves 23, 21, respectively. The high octane valve 21 is turned off after a sufficient quantity of high octane fuel is delivered and mixed with the low octane fuel remaining to provide a fuel mixture with an octane value equivalent to the mid octane selected, to compensate for the low octane fuel initially filling the outer hose 3. The microprocessor 53 is further programmed to turn off the mid octane valve 23 upon receiving a stop signal or upon delivery of a preselected quantity of mid octane fuel. Note that if during the time of concurrent turn on of both the high and mid octane valves 21 and 23, a stop or termination signal is received by microprocessor 53, the latter will operate to turn off both of the valves 21 and 23. If the dispensing cycle is terminated before compensation is complete, the microprocessor may be programmed to track the dispensing cycle as low octane.

Figure 7:
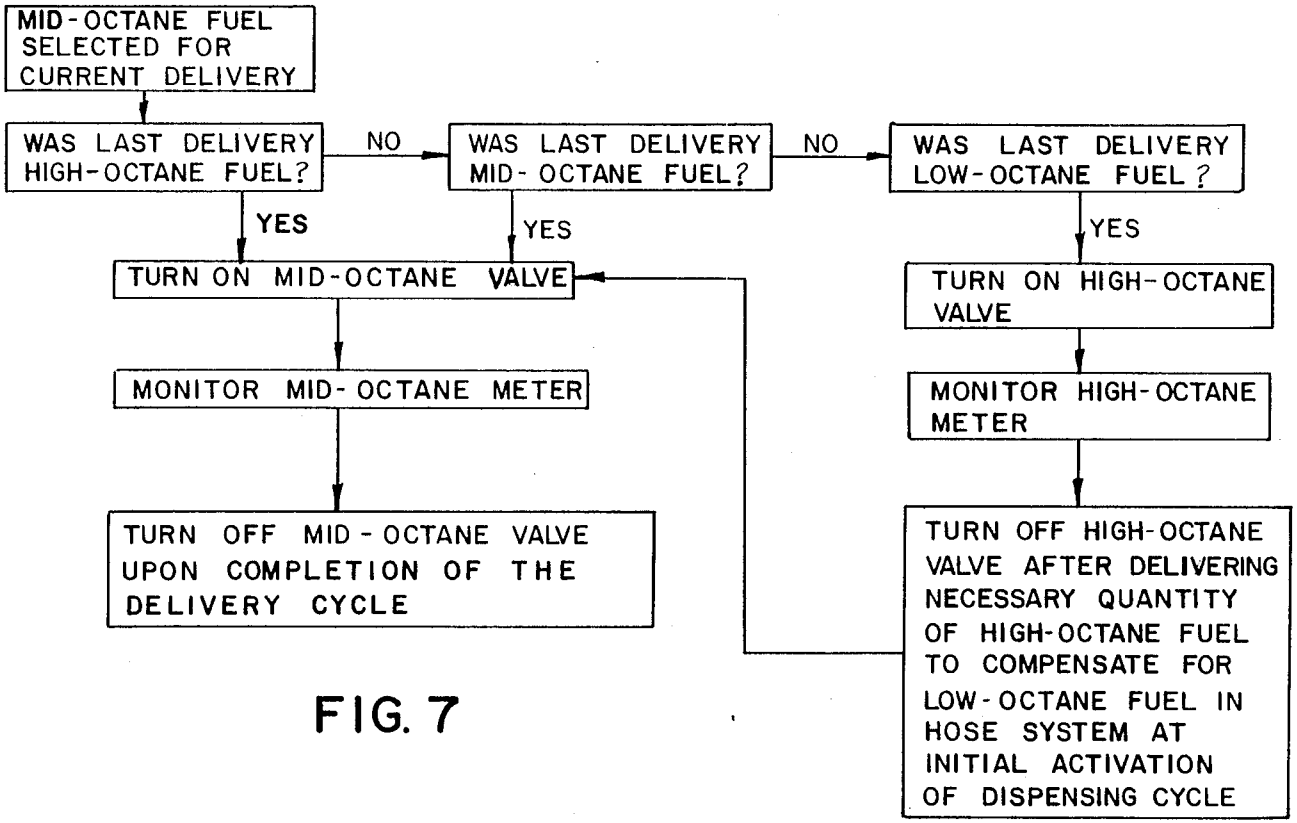

In the alternative embodiment shown in FIG. 7, for the programming of microprocessor 53 for dispensing mid octane fuel, if low octane fuel was delivered to outer hose 3, in the immediately prior dispensing cycle, microprocessor 53 is programmed, in this example, to first turn on the high octane valve 21 for delivering a sufficient quantity of high octane fuel through nozzle 5 for compensating for the low octane fuel in the outer hose 3. After delivering the high octane fuel, the high octane valve 21 is turned off, and simultaneously the mid octane valve 23 is turned on. In practice, it has been determined that shock due to pressure fluctuation is less if the valve "on" cycles overlap slightly so that the mid octane valve 23 is turned on slightly before the high octane valve 21 is turned off. Upon receipt of a stop termination signal, or upon delivery of a preselected quantity of mid octane fuel, microprocessor 53 operates to terminate an "on signal" to mid octane valve driver 57, for turning off mid octane valve 23.

Figure 8:
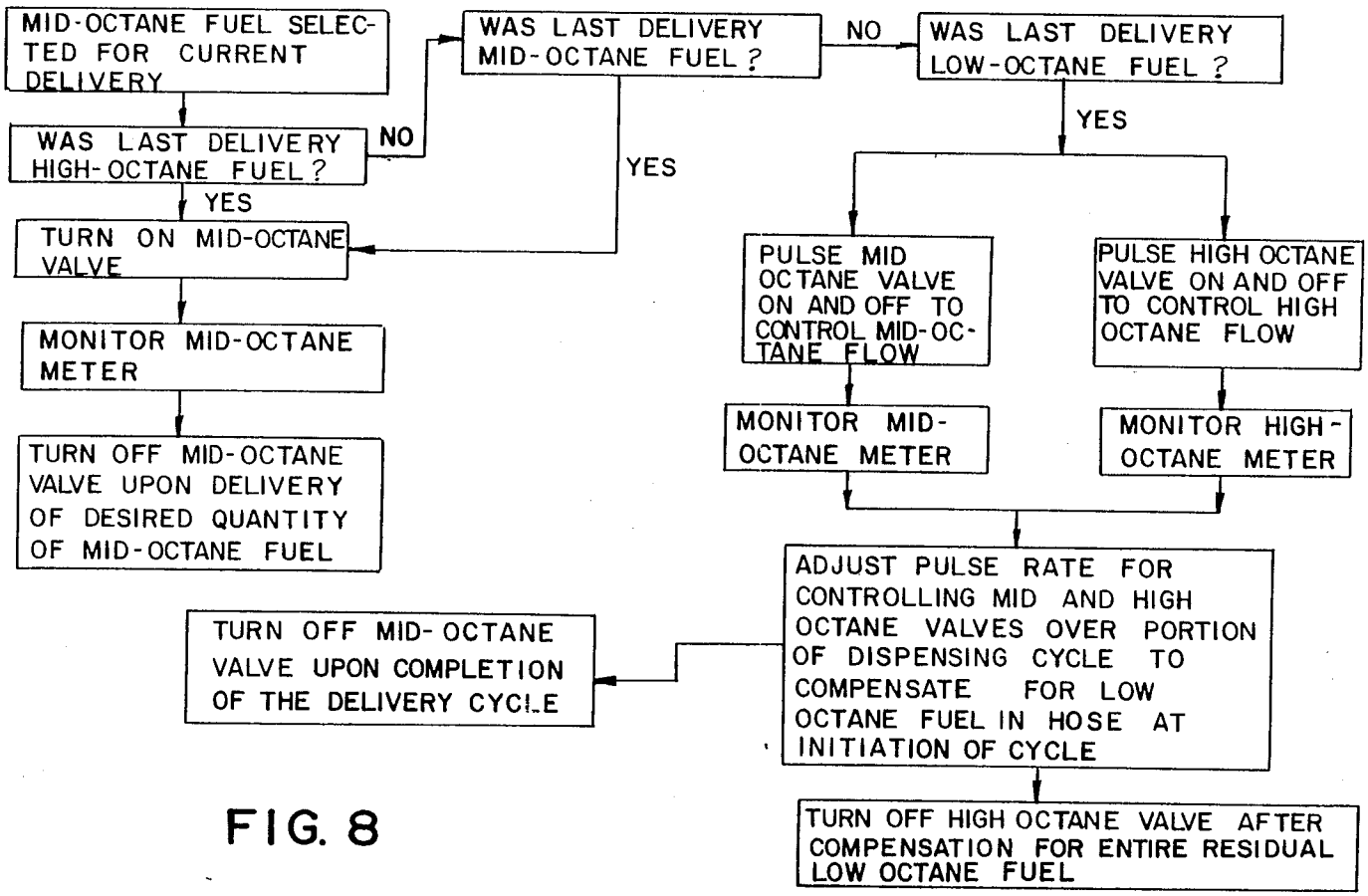

In FIG. 8, another embodiment is shown, in which the high valve 21 is turned on alone at the start of the compensation, and runs for a relatively short period of time, after which it is closed completely. The mid octane valve 23 is then turned on to dispense from outer hose 3 a small amount of the low product for compensation. Next, the mid octane valve 23 is closed and the high valve 21 is reopened for another short cycle of pulsed control, followed by a pulsed period of turn-on for mid octane valve 23. This controlled pulsing of valves 21, and 23 via microprocessor 53 continues until the entire residual low octane fuel initially filling outer hose 3, in this example, is compensated. Thereafter, the high valve 21 remains closed, and the mid octane valve 23 is opened continuously until the delivery cycle is finished.

Figure 9:
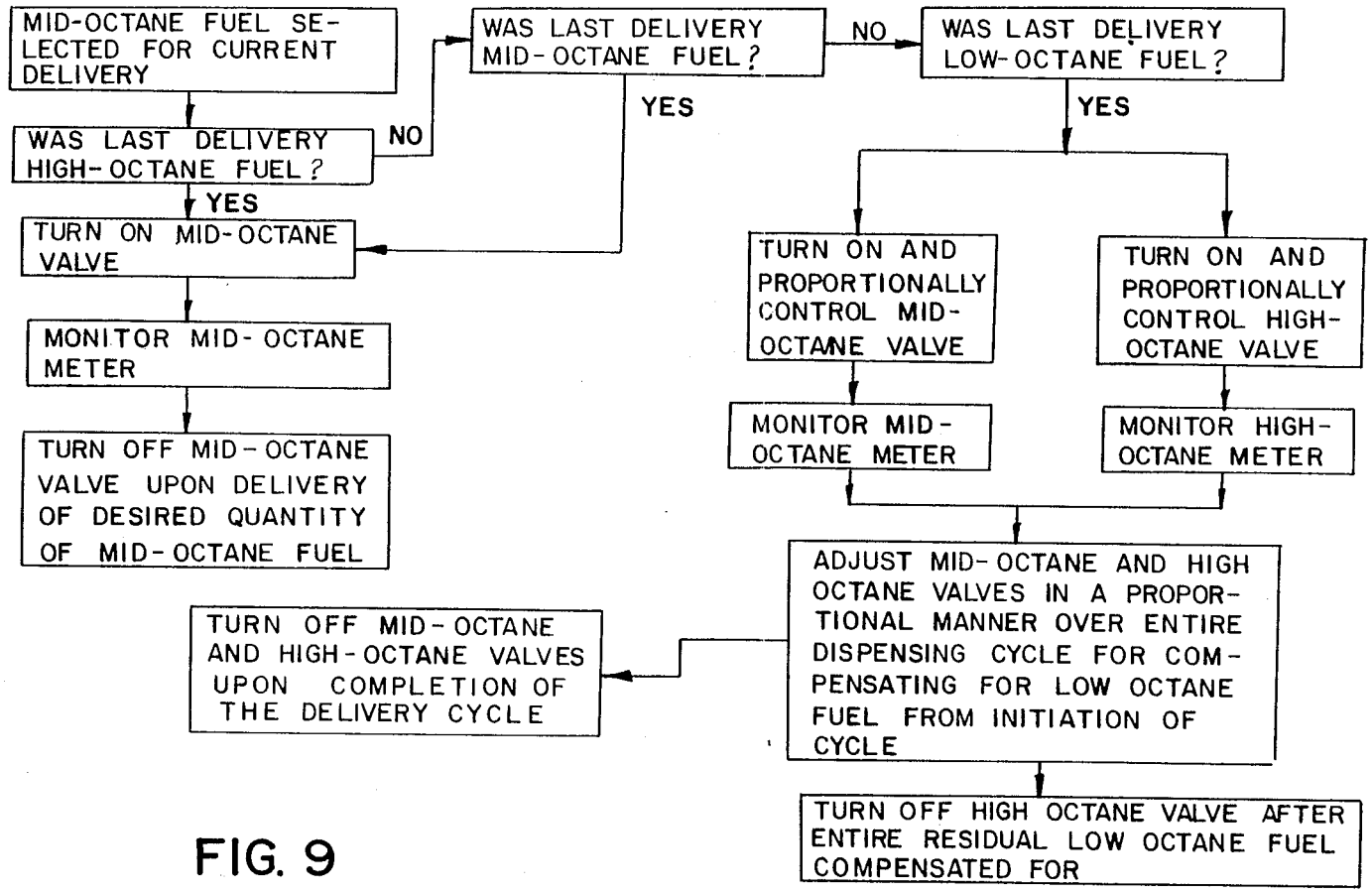

A flow chart for an alternative embodiment of the invention is shown in FIG. 9. In this embodiment, proportional control valves are used for valves 21, 23, and 25 rather than "on/off" valves. At the initiation of a mid-octane dispensing cycle after a low-octane dispensing cycle, the high flow control valve 21 and mid flow control valve 23 are simultaneously turned on when the delivery cycle starts. The valves 21 and 23 are proportionally controlled to adjust the flow rates via microprocessor 53 so that the residual low octane product is brought up to the correct mid octane level during the initial phases of the dispensing cycle.

Standard check valves 39, 41, and 43 located in high, mid, and low octane fuel delivery line paths shown in FIG. 1, may be included to prevent backflow of associated fuel from fuel lines 45, 47, and 49, respectively. A check valve 7 is shown at the other end of the high octane or inner product hose. As previously indicated, although conservative design may include such a check valve 7, it has been determined in prototype systems that the check valve 7 can be eliminated without any detrimental effects.

In any given dispensing cycle, if the system is operated in a preset mode for delivering a preprogrammed quantity of fuel, microprocessor 53 will generate a stop termination signal for turning off all valves 21, 23, and 25. However, when nozzle 5 is operated manually and turned off, one or more of valves 21, 23, and 25 will remain turned on until an operating handle (not shown) at the pump is turned off for causing a stop termination signal to be generated.

Although various embodiments of the invention have been shown herein for purposes of illustration, such embodiments are not meant to be limiting, and variations thereof may occur to those of ordinary skill in the art, which variations are meant to be covered by the spirit and scope of the appended claims. For example, in the hose within a hose configuration of FIG. 1, the outer hose 3 can be used to carry high octane fuel, and the inner hose low octane or mid octane fuel at different times. Similarly, the fuel carried in side-by-side hoses 1' and 3' can also be reversed. The teachings of the present invention can also be applied for use in dispensers having more than three grades of fuel, and/or fueling positions with both multi-fuel and single fuel dispensing nozzles.

What we claim is:

1. In a multi-fuel dispenser with a single nozzle per fueling position, including a nozzle having an inlet port; first and second hoses each having one end for discharging fuel into said inlet port; low and mid octane flow-control valves each having an outlet port connected to the other end of said first hose, and an inlet port connected to low and mid octane fuel supplies, respectively; and a high octane flow-control valve having an outlet port connected to the other end of said second hose, and an inlet port connected to a high octane fuel supply; a method for compensating for residual low octane fuel filling said first hose at the initiation of a mid octane fuel dispensing cycle, comprising the steps of:

monitoring the dispensing of low octane fuel relative to mid octane fuel;

turning on for a relatively short pulse-like period of time said high octane flow-control valve during a mid octane fuel dispensing cycle that immediately follows a low octane fuel dispensing cycle, for partially compensating for the residual low octane fuel dispensed during the mid octane fuel dispensing cycle;

turning off said high octane flow-control valve;

turning on for a relatively short pulse-like period of time said mid octane flow control valve;

turning off said mid octane flow control valve;

repeating the previous four steps in an iterative manner until the residual low octane fuel is fully compensated; and turning on said mid octane flow control valve for a period of time necessary to complete the dispensing of a desired quantity of mid octane fuel.

2. In a multi-fuel dispenser with a single nozzle per fueling position, including a nozzle having an inlet port; first and second hoses each having one end for discharging fuel into said inlet port; a low octane flow-control valve and a mid-octane proportional flow-control valve, each having an outlet port connected to the other end of said first hose, and an inlet port connected to low and mid octane fuel supplies, respectively; and a high octane proportional flow-control valve having an outlet port connected to the other end of said second hose, and an inlet port connected to a high octane fuel supply; a method for compensating for residual low octane fuel filling said first hose at the initiation of a mid octane fuel dispensing cycle, comprising the steps of:

monitoring the dispensing of low octane fuel relative to mid octane fuel;

turning on said mid and high octane proportional flow control valves during a mid octane fuel dispensing cycle that immediately follows a low octane fuel dispensing cycle;

proportionally controlling said mid and high octane proportional flow control valves for maximizing the precision of compensation of the residual low octane fuel from the initiation of the mid octane fueling cycle;

turning off said high octane proportional valve upon completing compensation for the residual low octane fuel; and turning off said mid octane proportional valve after delivering a desired quantity of mid octane fuel.

3. In a multi-fuel dispenser including a nozzle having an inlet port; first and second hoses each having one end for discharging fuel into said inlet port; first and second flow control valves each having an outlet port connected to the other end of said first hose, and an inlet port connected to low and mid octane fuel supplies, respectively; and a third flow control valve having an outlet port connected to the other end of said second hose, and an inlet port connected to a high octane fuel supply; a method for selectively dispensing from said nozzle one of said low, mid and high octane fuels without detrimental mixing of said fuels as a result of an immediately prior dispensing from said nozzle of a different one of said fuels, said method comprising the steps of:

operating only said third flow control valve for dispensing high octane fuel;

operating only said first flow control valve for dispensing low octane fuel;

monitoring the dispensing of low octane fuel relative to mid octane fuel; and turning on said third flow control valve during a mid octane fuel dispensing cycle following a low octane fuel dispensing cycle, and leaving said third flow control valve turned on for a sufficient period of time for delivering enough high octane fuel through said nozzle to compensate for the low octane fuel remaining in said first hose at the initiation of the mid octane fuel dispensing cycle.

4. The method of claim 3, further including in said compensation step, the step of:

turning on simultaneously both said second and third flow control valves upon initiation of a mid octane dispensing cycle following a low octane dispensing cycle.

5. The method of claim 3 further including in said compensating step, the steps of:

turning off said third flow control valve after delivering a sufficient amount of high octane fuel; and turning on said second flow control valve only after turning off said third flow control valve for a period of time necessary to complete delivery of a desired quantity of mid octane fuel.

6. The method of claim 3 further including in said compensating step, the steps of:

turning off said third flow control valve after delivering a sufficient amount of high octane fuel; and turning on said second flow control valve shortly before turning off said third flow control valve, and keeping the former turned on for a period of time necessary to complete delivery of a desired quantity of mid octane fuel.

7. In a multi-fuel dispenser having a single nozzle per fueling position, including a nozzle having an inlet port; first and second hoses each having one end for discharging fuel into said inlet port; first and second flow-control valves each having an outlet port connected to the other end of said first hose, and an inlet port connected to low and mid octane fuel supplies, respectively; and a third flow-control valve having an outlet port connected to the other end of said second hose, and an inlet port connected to a high octane fuel supply; a method for compensating for residual low octane fuel filling said first hose at the initiation of a mid octane fuel dispensing cycle, comprising the steps of:

monitoring the dispensing of low octane fuel relative to mid octane fuel; and turning on said third flow control valve during a mid octane fuel dispensing cycle that immediately follows a low octane fuel dispensing cycle for a period of time to deliver sufficient high octane fuel to compensate for the residual low octane fuel dispensed during the mid octane fuel dispensing cycle.

8. The method of claim 7, wherein said compensating step further includes the steps of:

turning on said second flow control valve substantially simultaneously with turning on said third flow control valve; and turning off said third flow control valve after a sufficient amount of high octane fuel has been delivered.

9. The method of claim 7 wherein said compensating step further includes the steps of:

turning on said third flow control valve at the initiation of said mid octane dispensing cycle;

turning off said third flow control valve upon delivery of a sufficient amount of high octane fuel; and turning on said second flow control valve upon turning off said third flow control valve, for a period of time necessary for completing the delivery or dispensing of mid octane fuel.

10. The method of claim 7, wherein said compensating step further includes the steps of:

turning on said third flow control valve at the initiation of said mid octane dispensing cycle;

turning off said third flow control valve upon delivery of a sufficient amount of high octane fuel; and turning on said second flow control valve shortly before turning off said third flow control valve, to prevent pressure of time necessary for completing the delivery or dispensing of mid octane fuel.

11. A multi-fuel dispenser with a single nozzle per fueling position, comprising:

low octane, mid octane, and high octane individual pressurized sources of gasoline;

a nozzle having an inlet port;

first and second hoses each having one end for discharging gasoline into said inlet port of said nozzle;

a first flow control valve connected between said low octane source of gasoline and the other end of said first hose;

a second flow control valve connected between said mid octane source of gasoline and the other end of said first hose;

a third flow control valve connected between said high octane source of gasoline and the other end of said second hose; and controller means programmed for (1) turning on only said third flow-control valve whenever high octane fuel is to be delivered from said nozzle, (2) turning on only said first flow control valve whenever low octane fuel is to be delivered from said nozzle, and (3) whenever mid octane fuel is to be delivered from said nozzle, in a first mode of operation only turning on said second flow control valve whenever the last delivery of fuel through said first hose was mid octane fuel, and in a second mode of operation subsequent to delivery of low octane fuel through said first hose, turning on said second flow-control valve, and turning on said third flow-control valve only for a period of time sufficient to mix in enough high octane gasoline for compensating for said first hose full of low octane gasoline.

12. The dispenser of claim 11, further including a mixing manifold having first and second input ports connected to output ports of said first and second flow control valves, respectively, and said mixing manifold having an output port connected to said first hose.

13. The dispenser of claim 11, further including one of said first and second hoses contained within the other.

14. The dispenser of claim 11, which said controller means is further programmed for operating in a third mode of operation whenever mid-octane fuel is to be dispensed, subsequent to delivery of low octane fuel through said first hose, for first only turning on said third flow-control valve for delivering only high octane gasoline for a period of time to compensate for the low octane gasoline initially in said first hose, whereafter said third valve is turned off and said second valve is turned on for the remainder of the dispensing cycle.

15. The dispenser of claim 14, wherein said controller means is further programmed for in the third mode of operation turning on said second valve before turning off said third valve, to prevent pressure pulsations.

16. A multi-fuel dispenser with a single nozzle per fueling position, comprising:

a nozzle for selectively dispensing fuels, said nozzle having an inlet port for connection to at least one hose;

a first hose having one end for discharging fuel into said inlet port, and another end for receiving at different times either a mid octane fuel or a low octane fuel under pressure, for dispensing from said nozzle;

a second hose having one end for discharging fuel into said inlet port, and another end for receiving high octane fuel under pressure for injection substantially at said nozzle; and supply means connected to said another ends of said first and second hoses, for selectively supplying to said nozzle at least low octane fuel during a low octane dispensing cycle, high octane fuel during a high octane dispensing cycle, and mid octane fuel during a mid octane dispensing cycle, plus an initial amount of any fuel remaining in said first hose from a last low or mid dispensing cycle through that hose, said supply means further including compensating means for injecting via said second hose, a sufficient quantity of high octane fuel into said nozzle at the initiation of a mid octane fuel dispensing cycle subsequent to a low octane fuel dispensing cycle, for mixing with the latter to insure that the total quantity of fuel dispensed has at least a mid octane fuel rating, thereby compensating for the residual quantity of low octane fuel remaining in said first hose.

17. The multi-fuel dispenser of claim 16, wherein said compensating means immediately prior to the delivery of mid octane fuel subsequent to a low octane fuel dispensing cycle through said first hose, is operative for injecting the sufficient quantity of high octane fuel into said nozzle for compensating for the low octane fuel remaining in said second hose.

18. The multi-fuel dispenser of claim 16, wherein said compensating means, upon the initiation of delivery of mid octane fuel subsequent to a low octane fuel dispensing cycle, is operative for at the same time injecting the sufficient quantity of high octane fuel into said nozzle.

19. The multi-fuel dispenser of claim 16, further including one of said first and second hoses contained within the other.

20. The multi-fuel dispenser of claim 16, further including said first and second hoses juxtaposed to one another.

21. The multi-fuel dispenser of claim 16, wherein said supply means including said compensating means includes:

first flow control valve means connected in the fuel flow path between a source of low octane fuel and said another end of said first hose, selectively operable for controlling the delivery of low octane fuel to said nozzle;

second flow control valve means connected between a source of mid octane fuel and said another end of said first hose, selectively operable for controlling the delivery of mid octane fuel to said nozzle;

third flow control valve means connected between a source of high octane fuel and said another end of said second hose, selectively operable for controlling the delivery of high octane fuel to said nozzle; and controller means programmed for (1) turning on only said third flow-control valve means whenever high octane fuel is to be delivered from said nozzle; (2) turning on only said first flow control valve means whenever low octane fuel is to be delivered from said nozzle, and (3) whenever mid octane fuel is to be delivered from said nozzle, in a first mode of operation only turning on said second flow control valve means whenever the last delivery of fuel through said second hose was mid octane fuel, in a second mode of operation subsequent to delivery of low octane fuel through said first hose, turning on said second flow control valve means, and turning on said third flow-control valve means for a period of time sufficient to mix in enough high octane gasoline for compensating for said first hose full of low octane gasoline.

22. The multi-fuel dispenser of claim 21, wherein said controller means further includes a microprocessor programmed for selectively turning on and off said first through third flow control valve means for delivering from said nozzle at different times either low octane, mid octane, or high octane fuel.

23. The multi-fuel dispenser of claim 21, wherein said first, second, and third flow control valve means each include the series connection of a flow control valve and a flow meter.

* * * * *

UNITED STATES PATENT AND TRADEMARK OFFICE

CERTIFICATE OF CORRECTION

PATENT NO. : 4,978,029

DATED : December 18, 1990

INVENTOR(S) : Roger W. Furrow and Harold R. Young

It is certified that error appears in the above-identified patent and that said Letters Patent is hereby corrected as shown below:

On the title page:

In the ABSTRACT, line 11, change "initiator" to --initiation--.

Column 3, lines 20 and 26, after "hoses" insert --1--.

Column 4, line 14, change "I n" to --In--.

Column 6, line 14, after "hose" insert --1--.

Column 9, line 1, after "pressure" insert --pulsations, and leaving said second valve turned on for a period--.

Signed and Sealed this

Tenth Day of March, 1992

*Attest:*

HARRY F. MANBECK, JR.

*Attesting Officer*

*Commissioner of Patents and Trademarks*